US008047167B2

(12) United States Patent
Hirayama et al.

(10) Patent No.: US 8,047,167 B2
(45) Date of Patent: Nov. 1, 2011

(54) MULTI-CYLINDER INTERNAL COMBUSTION ENGINE

(75) Inventors: Taku Hirayama, Saitama (JP); Hayato Maehara, Saitama (JP); Takaaki Tsukui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 452 days.

(21) Appl. No.: 11/905,099

(22) Filed: Sep. 27, 2007

(65) Prior Publication Data

US 2008/0078342 A1 Apr. 3, 2008

(30) Foreign Application Priority Data

Sep. 29, 2006 (JP) ..... 2006-270021

(51) Int. Cl.
*F01L 9/02* (2006.01)

(52) U.S. Cl. ..... 123/90.12; 123/90.15; 123/90.17; 123/193.5

(58) Field of Classification Search ..... 123/90.12, 123/90.13, 90.6, 90.15, 90.17, 193.3, 193.5
See application file for complete search history.

(56) References Cited

U.S. PATENT DOCUMENTS

| | | | | |
|---|---|---|---|---|
| 5,143,034 | A | 9/1992 | Hirose | |
| 5,305,718 | A | 4/1994 | Muller | |
| 5,540,197 | A | 7/1996 | Golovatai-Schmidt et al. | |
| 6,076,492 | A | 6/2000 | Takahashi | |
| 6,138,621 | A | 10/2000 | Albanello et al. | |
| 6,302,070 | B1 * | 10/2001 | Tsukui et al. | 123/90.16 |
| 6,318,316 | B1 | 11/2001 | Tsukui et al. | |
| 6,386,163 | B2 * | 5/2002 | Tsukui et al. | 123/90.16 |
| 7,040,265 | B2 | 5/2006 | Falkowski et al. | |

FOREIGN PATENT DOCUMENTS

| | | | |
|---|---|---|---|
| DE | 34 15 245 | C2 | 12/1984 |
| DE | 34 45 951 | A1 | 6/1985 |
| DE | 697 03 511 | T2 | 6/2001 |
| DE | 102 56 447 | A1 | 6/2003 |
| DE | 601 18 478 | T2 | 9/2006 |
| DE | 10 2007 012 093 | A3 | 10/2007 |
| EP | 1 462 622 | A1 | 9/2004 |
| JP | 61-94211 | | 5/1986 |
| JP | 05-195831 | | 8/1993 |
| JP | 2004-293379 | A | 10/2004 |

* cited by examiner

*Primary Examiner* — Ching Chang
(74) *Attorney, Agent, or Firm* — Birch, Stewart, Kolasch & Birch, LLP

(57) ABSTRACT

In a multi-cylinder internal combustion engine, a hydraulic valve rest mechanism is mounted on a valve operating device, which performs open-close driving of an engine valve which is arranged in a cylinder head of an engine body having a plurality of cylinders in an openable-and-closable manner. The hydraulic valve rest mechanism is operated with an oil pressure that is controlled by a hydraulic control device so as to close and rest engine valves of a plurality of cylinders for bringing the cylinders into a rest state Therefore, the miniaturization of the multi-cylinder internal combustion engine along an axis of a crankshaft and can shorten a length of an oil passage which connects a hydraulic valve rest mechanism and a hydraulic control device. A hydraulic control device is arranged on an engine body directly above a portion thereof corresponding to a cylinder that is expected to assume a cylinder rest state.

18 Claims, 8 Drawing Sheets

3
24
71
8
2
16
35
36
38
34
39
27
23A~23D
32
21
37
15
11
40
30
33
31
22
19
20
18
C
2
14
12
90
17A~17D
13

MULTI-CYLINDER INTERNAL COMBUSTION ENGINE

CROSS-REFERENCE TO RELATED APPLICATIONS

This nonprovisional application claims priority under 35 U.S.C. §119(a) on Patent Application No. 2006-270021, filed in Japan on Sep. 29, 2006, the entirety of which is incorporated herein by reference.

BACKGROUND OF THE INVENTION

1. Field of the Invention

The present invention relates to a multi-cylinder internal combustion engine in which a hydraulic valve rest mechanism is mounted on a valve operating device that performs open-close driving of an engine valve. The engine valve is arranged in an openable-and-closable manner in a cylinder head of an engine body having a plurality of cylinders. The hydraulic valve rest mechanism is operated by an oil pressure that is controlled by a hydraulic control device so as to close and rest the engine valves of one or more of the plurality of cylinders for bringing the cylinders into a rest state.

2. Background of the Invention

Such a multi-cylinder internal combustion engine has already been known in JP-A-2004-293379 or the like, for example. However, in the multi-cylinder internal combustion engine that is disclosed in the above-mentioned JP-A-2004-293379, a hydraulic control device is arranged on a side of a head cover in the direction along an axis of a crankshaft. Hence, the entire internal combustion engine becomes large in size in the direction along the axis of the crankshaft and an oil passage that connects a hydraulic valve rest mechanism and a hydraulic control device is elongated.

SUMMARY OF THE INVENTION

The present invention has been made under such circumstances and it is an object of the present invention to provide a multi-cylinder internal combustion engine that can miniaturize the engine in the direction along an axis of a crankshaft and can shorten a length of an oil passage that connects a hydraulic valve rest mechanism and a hydraulic control device.

To achieve the above-mentioned object, a first aspect of the present invention is directed to a multi-cylinder internal combustion engine in which a hydraulic valve rest mechanism is mounted on a valve operating device which performs open-close driving of an engine valve which is arranged in a cylinder head of an engine body having a plurality of cylinders in an openable-and-closable manner, the hydraulic valve rest mechanism being operated by an oil pressure that is controlled by a hydraulic control device so as to close and rest engine valves of one or more of the plurality of cylinders for bringing the cylinders into a rest state, wherein the hydraulic control device is arranged on the engine body directly above a portion thereof corresponding to the cylinder that is expected to assume the cylinder rest state.

Furthermore, according to a second aspect of the present invention, the hydraulic control device is directly mounted on a head cover, which constitutes a portion of the engine body and which is joined to the cylinder head.

Still further, according to a third aspect of the present invention, the engine body is configured to include four cylinders in series, and the hydraulic valve rest mechanism is mounted on the valve operating device at portions thereof which correspond to the cylinders at both ends along the arranging direction of the cylinders.

According to that first aspect of the present invention, the hydraulic control device is arranged on the engine body directly above the cylinder that is expected to assume the cylinder rest state. Hence, it is possible to miniaturize the entire engine in the direction along the axis of the crankshaft and to shorten a length of an oil passage that connects a hydraulic valve rest mechanism and a hydraulic control device.

Further, according to the second aspect of the present invention, the hydraulic control device is directly mounted on the head cover. Hence, parts dedicated for supporting the hydraulic control device become unnecessary, whereby the number of parts can be decreased thus reducing a cost and, at the same time, a length of an oil passage that connects a hydraulic valve rest mechanism and a hydraulic control device can be shortened.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
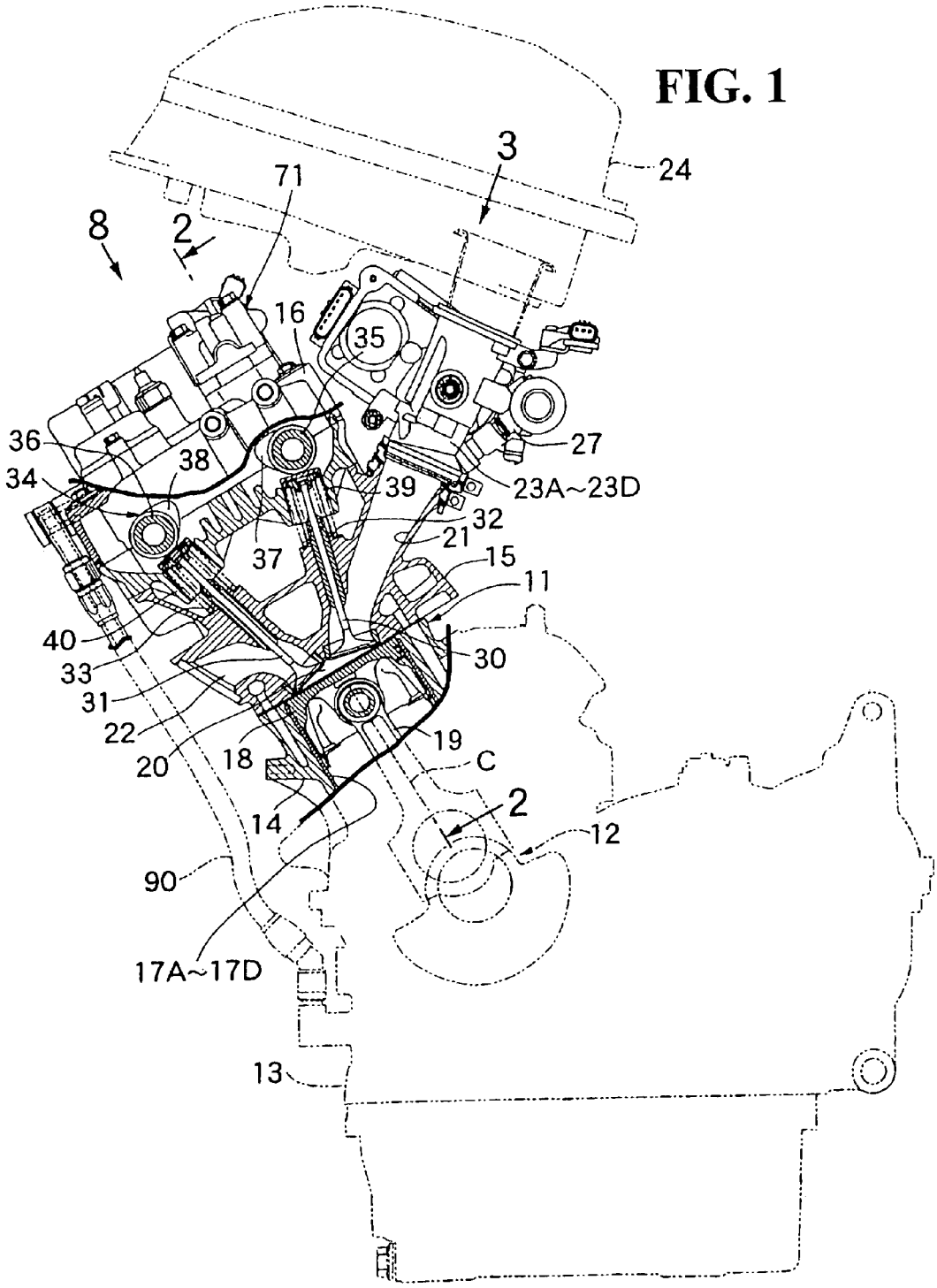
FIG. 1 is a longitudinal cross-sectional side view of an engine body.

The present invention will now be described in detail with reference to the accompanying drawings, wherein the same reference numerals will be used to identify the same or similar elements throughout the several views. It should be noted that the drawings should be viewed in the direction of orientation of the reference numerals.

Figure 2:
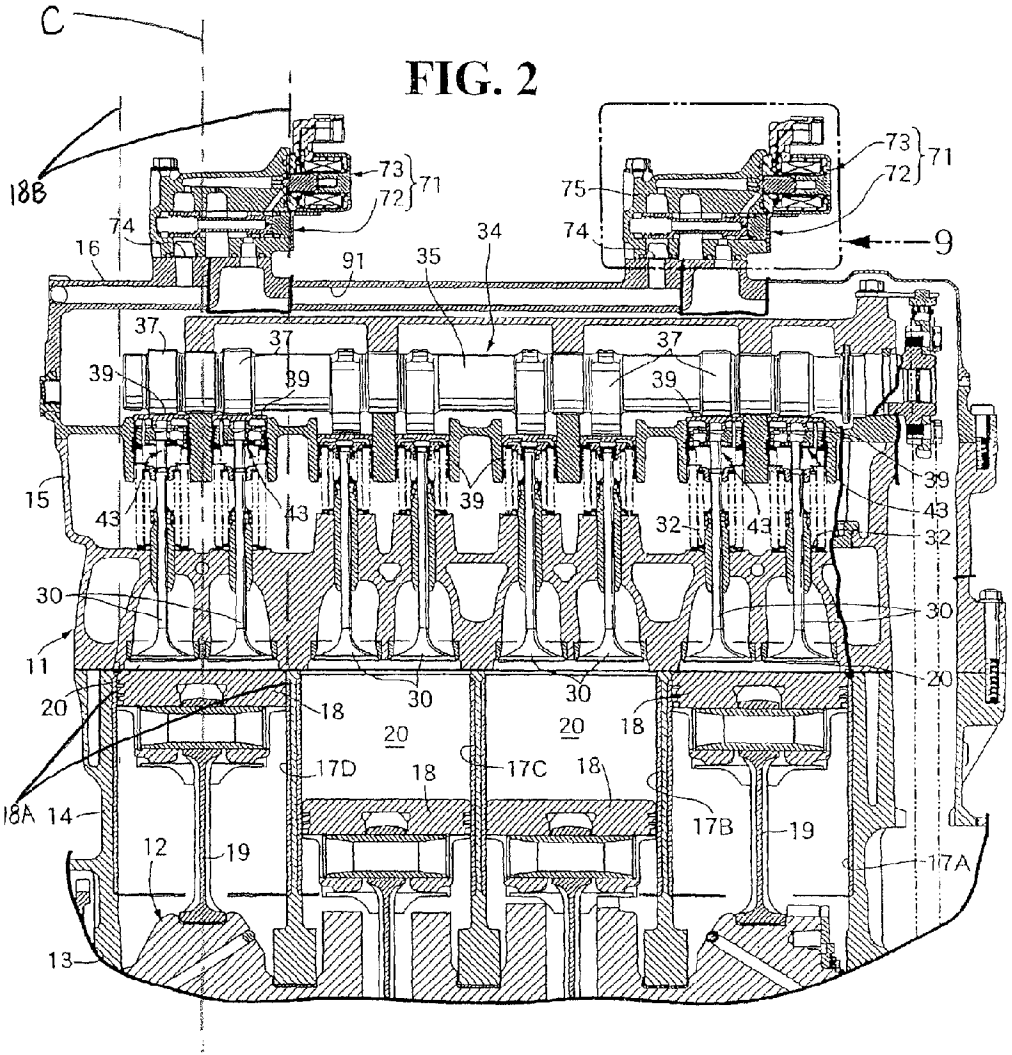
FIG. 2 is a cross-sectional view taken along a line 2-2 in FIG. 1.
Figure 3:
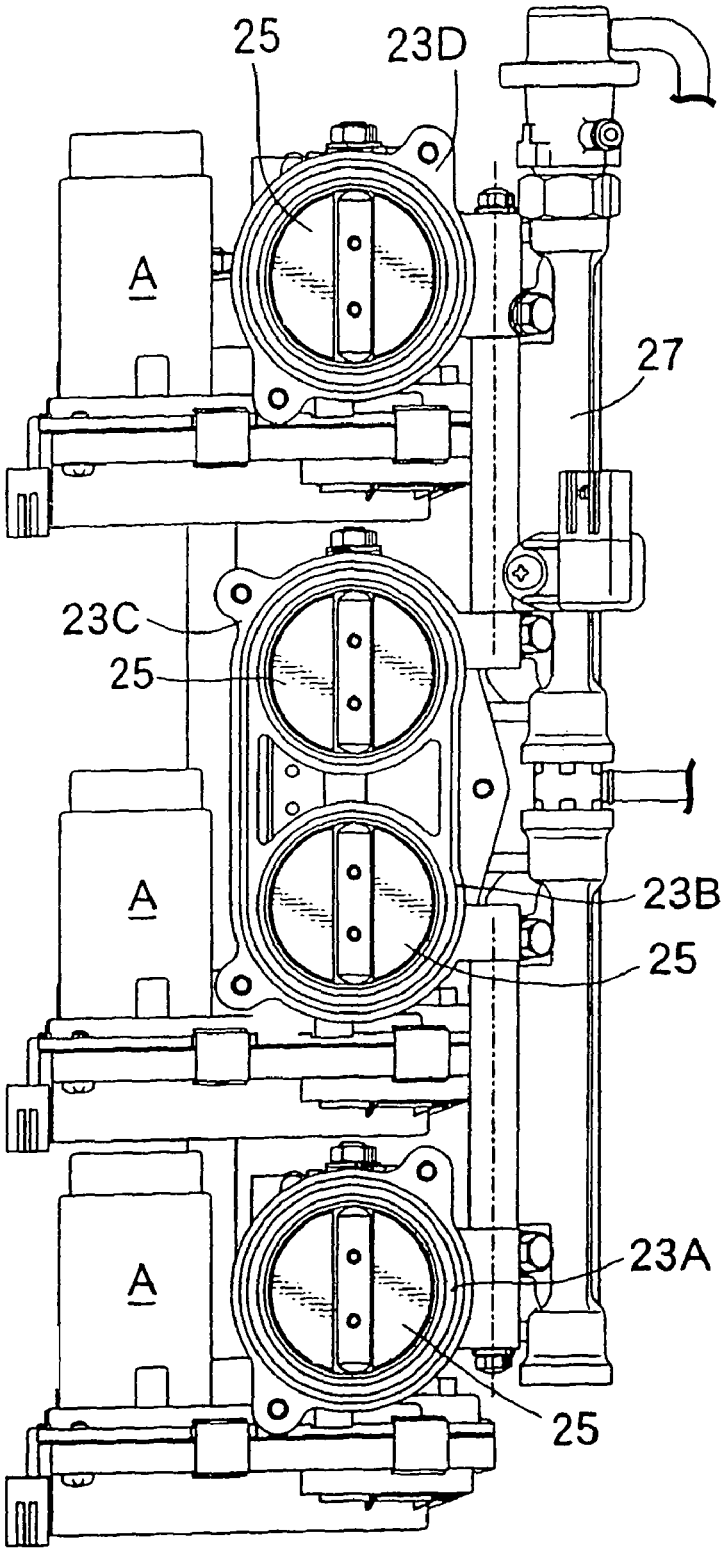
FIG. 3 is a view as viewed in the direction of an arrow 3 in FIG. 1.
Figure 4:
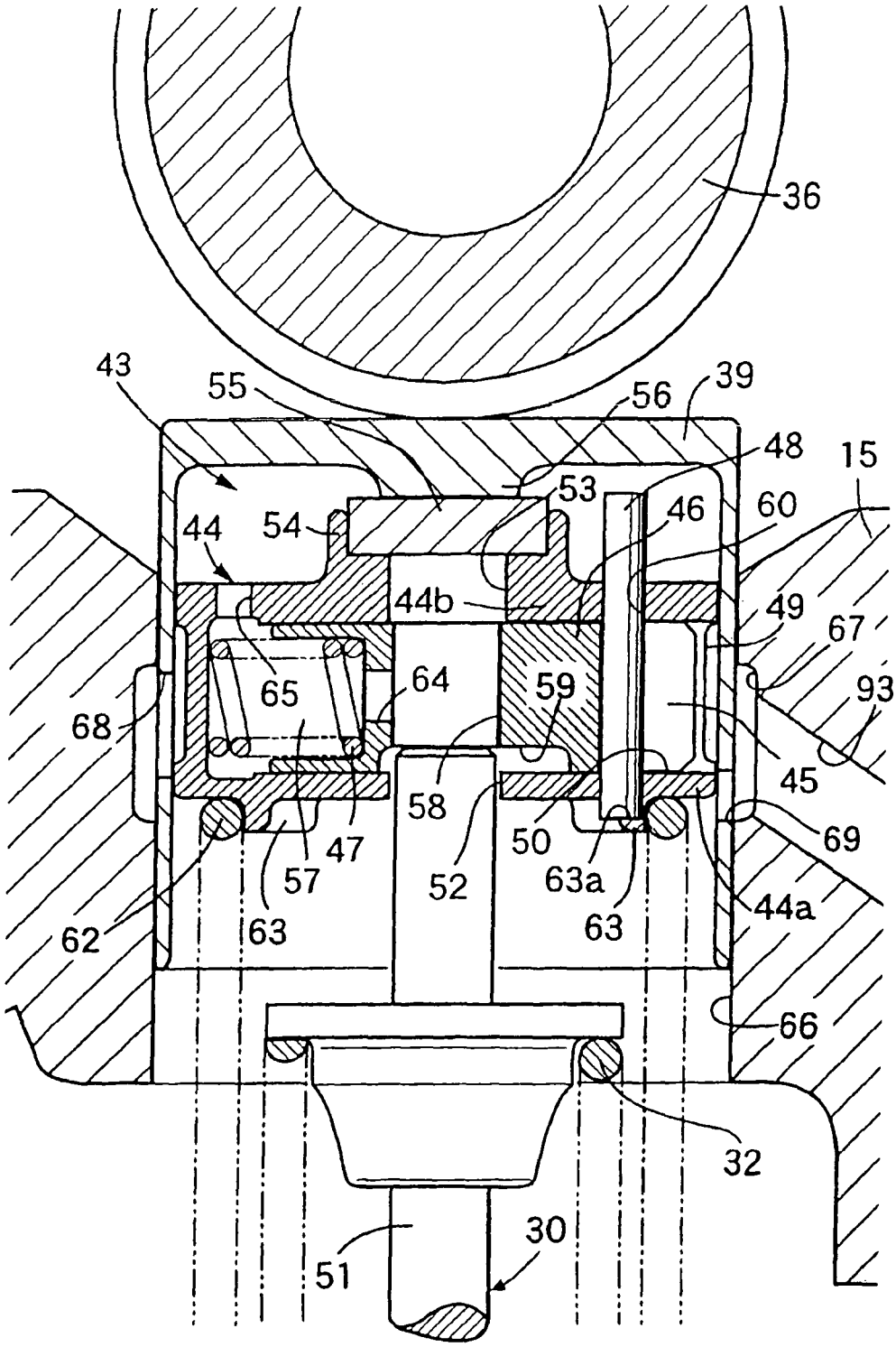
FIG. 4 is a longitudinal cross-sectional view showing the construction of a hydraulic valve rest mechanism.
Figure 5:
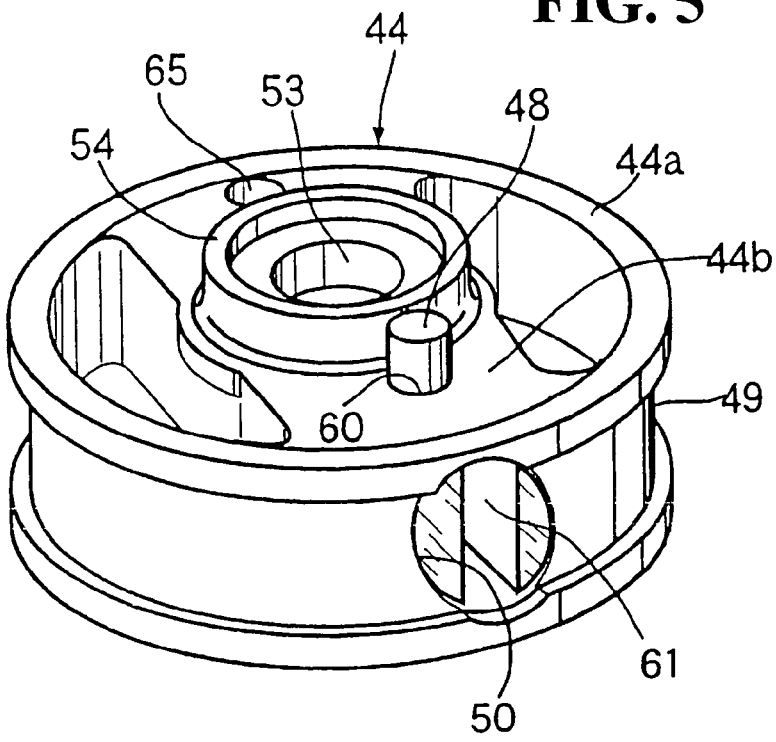
FIG. 5 is a perspective view of a pin holder as viewed from above.
Figure 6:
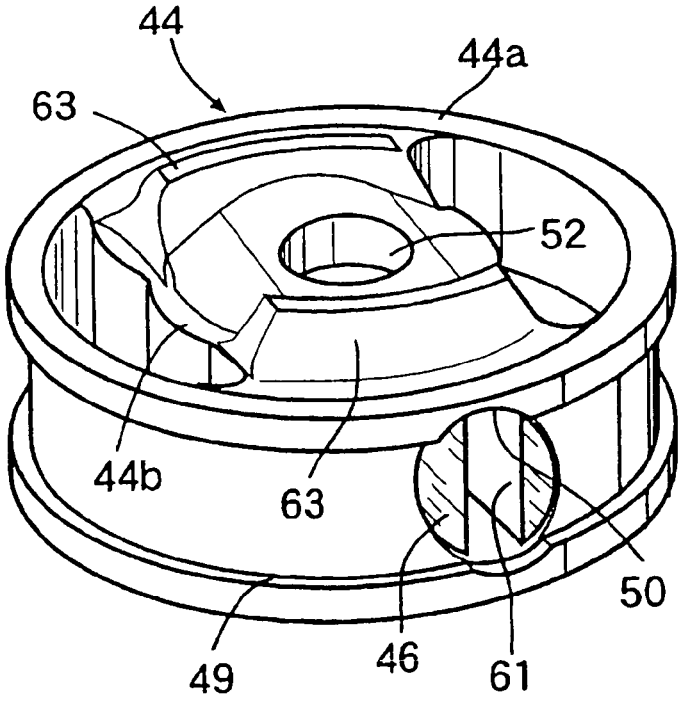
FIG. 6 is a perspective view of the pin holder as viewed from below.
Figure 7:
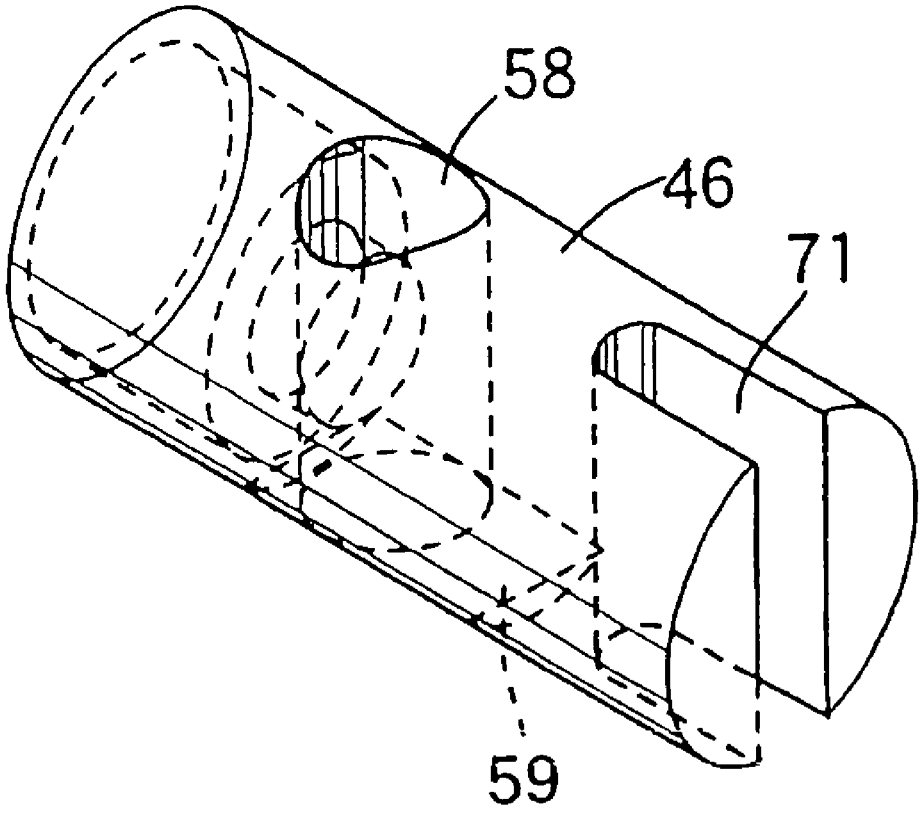
FIG. 7 is a perspective view of a slide pin.
Figure 8:
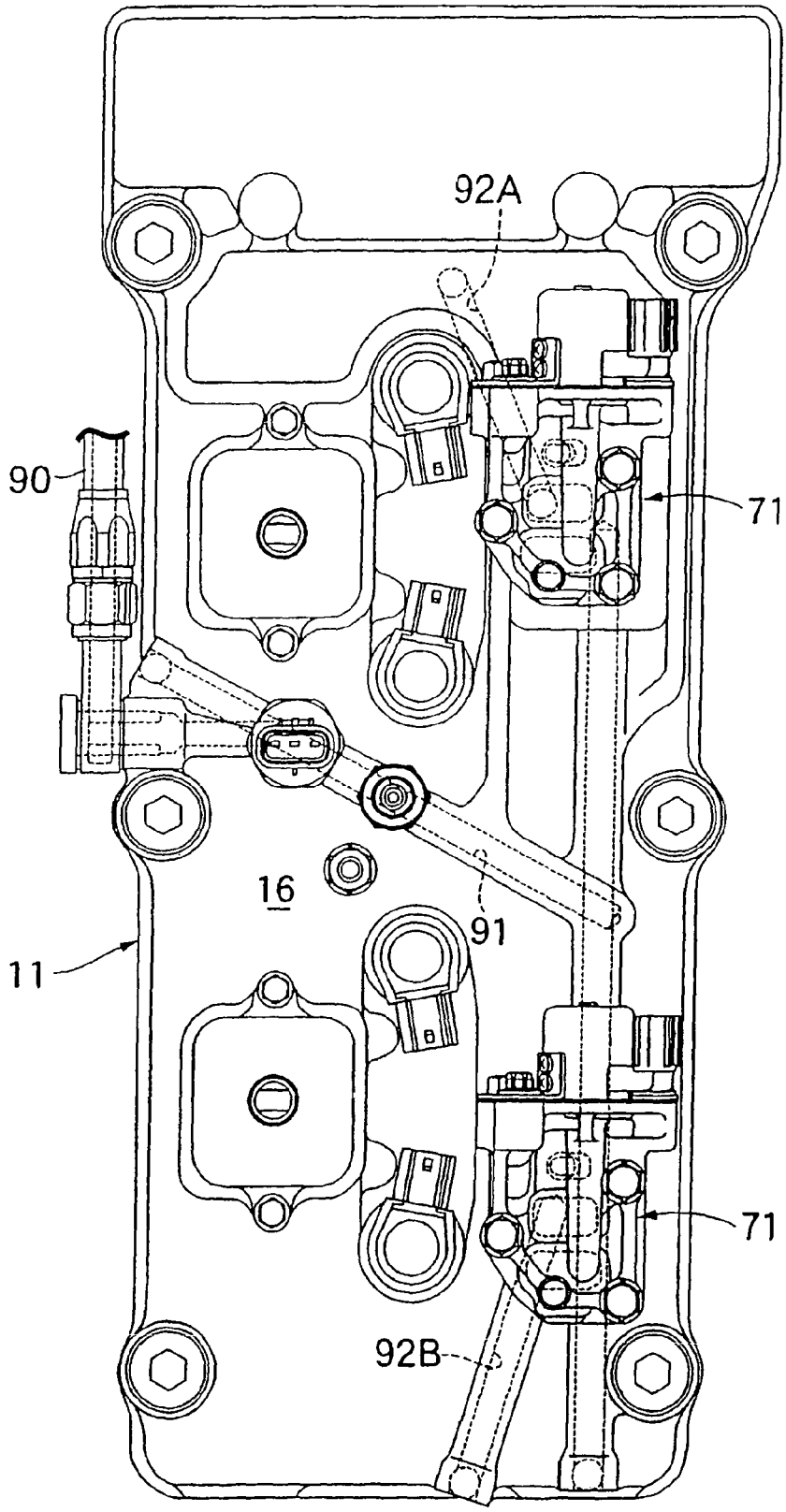
FIG. 8 is a view as viewed in the direction of an arrow 8 in FIG. 1.
Figure 9:
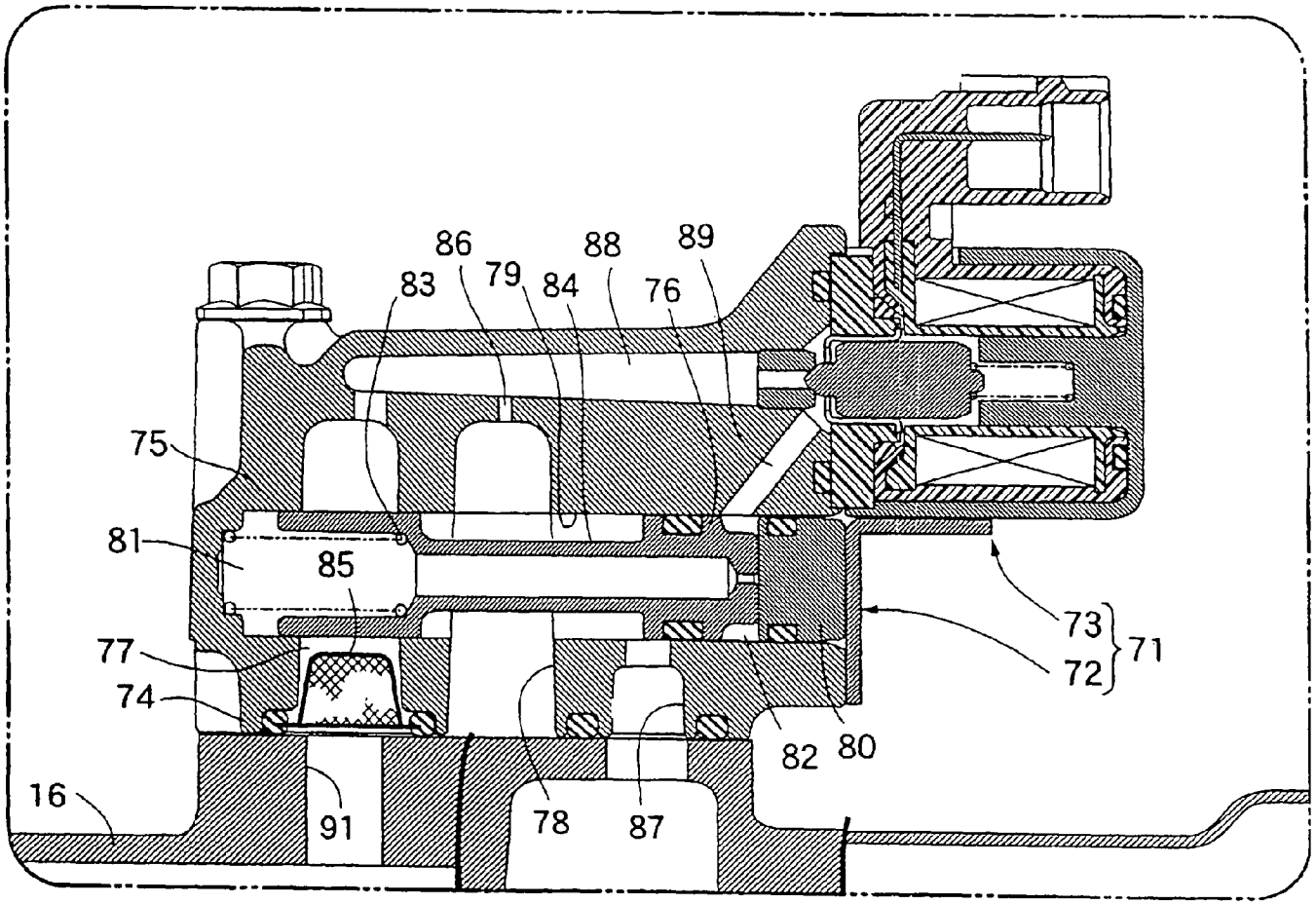
FIG. 9 is an enlarged view of a portion indicated by an arrow 9 in FIG. 2.

FIG. 1 to FIG. 9 show one embodiment of the present invention. FIG. 1 is a longitudinal cross-sectional side view of an engine body. FIG. 2 is a cross-sectional view taken along a line 2-2 in FIG. 1. FIG. 3 is a view as viewed in an arrow 3 direction in FIG. 1. FIG. 4 is a vertical cross-sectional view showing the construction of a hydraulic valve rest mechanism. FIG. 5 is a perspective view of a pin holder as viewed from above. FIG. 6 is a perspective view of the pin holder as viewed from below. FIG. 7 is a perspective view of a slide pin. FIG. 8 is a view as viewed from an arrow 8 direction in FIG. 1. FIG. 9 is an enlarged view of a portion indicated by an arrow 9 in FIG. 2.

First of all, in FIG. 1 and FIG. 2, an engine body 11 of the internal combustion engine adopts an in-line four-cylinder construction and is mounted on a motorcycle, for example. The engine body 11 includes a crankcase 13 that rotatably supports a crankshaft 12 having an axis arranged along a width direction of the motorcycle, a cylinder block 14 that is joined to the crankcase 13, a cylinder head 15 that is joined to the cylinder block 14 and a head cover 16 that is joined to the cylinder head 15.

Four cylinder bores 17A, 17B, 17C, 17D, which are arranged in parallel in the direction along an axis of the crankshaft 12, are provided to the cylinder block 14. A cylinder axis C of the respective cylinder bores 17A to 17D is inclined in the frontward and upward direction. Pistons 18 are slidably fitted in the respective cylinder bores 17A to 17D. Each of the pistons 18 has an outer surface 18A in contact with each of the cylinder bores 17A to 17D. The respective pistons 18 are connected to the crankshaft 12 by way of a connecting rods 19.

Combustion chambers 20, which top portions of the pistons 18 that are respectively slidably fitted in the cylinder bores 17A to 17D face, are formed for every cylinder between the cylinder block 14 and the cylinder head 15. Furthermore, in the cylinder head 15, intake ports 21 and discharge ports 22, which are in communication with the combustion chambers 20, are formed for every cylinder. The intake ports 21 are opened in a side surface of a rear portion of the cylinder head 15. The discharge ports 22 are opened in a side surface of a front portion of the cylinder head 15.

To explain the embodiment also in conjunction with FIG. 3, throttle bodies 23A to 23D are independently connected to the respective intake ports 21 of the cylinder head 15. Furthermore, the respective throttle bodies 23A, 23B, 23C, 23D are commonly connected to an air cleaner 24 arranged above the throttle bodies 23A to 23D.

Cylinders at both ends along the arranging direction of the cylinders out of the in-line four cylinders are cylinders that are expected to assume the cylinder rest state. Two cylinders, which are arranged at the center along the cylinder arranging direction, are cylinders that are always operated during running of the engine. As shown in FIG. 3, the throttle valves 25, 25 of the throttle bodies 23A, 23D, which correspond to both-end cylinders that are arranged along the cylinder arranging direction, that is, the cylinder bores 17A, 17D, are opened and closed by actuators A, A which are individually mounted on the throttle bodies 23A, 23D. On the other hand, the throttle bodies 23B, 23C, which correspond to two cylinders at the center that are arranged along the cylinder arranging direction, that is, cylinder bores 17B, 17C, are integrally joined with each other. The throttle valves 25, 25 of both throttle bodies 23B, 23C are opened and closed by the actuator A which is mounted on one of both throttle bodies 23B, 23C. Furthermore, an electrical actuator having an electrically-operated motor (not shown in the drawing) is adopted as the respective actuators A.

Fuel injection valves 26 which inject fuel toward the intake ports 21 are respectively mounted on the respective throttle bodies 23A to 23D. The respective fuel injection valves 26 are connected to a common fuel rail 27.

Returning to FIG. 1 and FIG. 2, in the cylinder head 15, a pair of intake valves 30, 30 and a pair of discharge valves 31, 31, which constitute engine valves, are mounted for every cylinder in an openable and closable manner. The respective intake valves 30 are biased in the valve closing direction by valve springs 32. The respective discharge valves 31 are biased in the valve closing direction by valve springs 33.

A valve operating device 34, which opens and closes the intake valves 30 and the discharge valves 31, is accommodated between the cylinder head 15 and the head cover 16. The valve operating device 34 includes an intake-side cam shaft 35 and a discharge-side cam shaft 36 to which a rotational force is transmitted from the crankshaft 12 by way of a timing transmission device (not shown in the drawing) at a reduction ratio of 1/2. Intake-side valve lifters 39 are interposed between intake-side valve-operating cams 37 mounted on the intake-side cam shaft 35 and intake valves 30 and are slidably fitted in the cylinder head 15. Discharge-side valve lifters 40 are interposed between discharge-side cams 38 mounted on the discharge-side cam shaft 36 and the discharge valves 31 and are slidably fitted in the cylinder head 15.

Furthermore, the hydraulic valve rest mechanisms 43, 43, which close and rest the intake valves 30 for bringing the cylinders into a rest state, are respectively mounted on the valve operating device 34 at portions thereof that correspond to the cylinders arranged at both ends along the arranging direction out of the in-line four cylinders.

In FIG. 4, the hydraulic valve rest mechanism 43 is provided in association with the intake-side valve lifter 39. The hydraulic valve rest mechanism 43 includes a pin holder 44, which is slidably fitted in the intake-side valve lifter 39. A slide pin 46 forms a hydraulic chamber 45 between the slide pin 46 and an inner surface of the intake-side valve lifter 39, and is slidably fitted in the pin holder 44. A return spring 47 exhibits a spring force for biasing the slide pin 46 in the direction where a capacity of the hydraulic chamber 45 is decreased, and is provided between the slide pin 46 and the pin holder 44. A stopper pin 48 prevents the slide pin 46 from being rotated about an axis of the slide pin 46, and is provided between the pin holder 44 and the slide pin 46.

To explain the embodiment also in conjunction with FIG. 5 and FIG. 6, the pin holder 44 is integrally formed of a ring portion 44*a*, which is slidably fitted in the inside of the intake-side valve lifter 39, and a bridge portion 44*b*, which connects portions of an inner periphery of the ring portion 44*a* along one diameter line of the ring portion 44*a*. Hollow spaces are formed between the inner periphery of the ring portion 44*a* and the both side surfaces of the bridge portion 44*b* for realizing a reduction in weight.

An annular groove 49 is formed in an outer periphery of the pin holder 44, that is, in an outer periphery of the ring portion 44*a*. A bottom slide hole 50 is formed in the bridge portion 44*b* of the pin holder 44. The bottomed slide hole 50 has an axis thereof orthogonal to an axis along one diameter line of the ring portion 44*a*, that is, an axis of the intake-side valve lifter 39, and has one end thereof opened in the annular groove 49 and has another end thereof closed. Further, in a center lower portion of the bridge portion 44*b*, an insertion hole 52, through which a distal end portion of a valve stem 51 of the intake valve 30 biased in the valve closing direction by the valve spring 32 is passed, is formed in a state where the insertion hole 52 has an inner end thereof opened in the slide hole 50. In a center upper portion of the bridge portion 44*b*, an extension hole 53 that sandwiches the slide hole 50 with the insertion hole 52 is formed coaxially with the insertion hole 52 in a state where the extension hole 53 can accommodate the distal end portion of the valve stem 51 of the intake valve 30.

Furthermore, an accommodating sleeve portion 54, which has an axis thereof aligned with the axis of the extension hole 53, is integrally formed with a bridge portion 44*b* of the pin holder 44 at a position where the bridge portion 44*b* faces a closed end of the intake-side valve lifter 39. A portion of a disc-like shim 55, which closes an end portion of the extension hole 53, is fitted in the accommodating sleeve portion 54 on a closed-end side of the intake-side valve lifter 39. Furthermore, a projection 56 that is brought into contact with the shim 55 is integrally formed on a center portion of a closed-end inner surface of the intake-side valve lifter 39. A slide pin 46 is slidably fitted in the slide hole 50 of the pin holder 44. The hydraulic chamber 45, which is in communication with the annular groove 49, is defined between one end of the slide pin 46 and the inner surface of the intake-side valve lifter 39. The return spring 47 is accommodated in a spring chamber 57 that is defined between another end of the slide pin 46 and the closed end of the slide hole 50.

To explain the embodiment also in conjunction with FIG. 7, on an axially intermediate portion of the slide pin 46, an accommodating hole 58 that is coaxially communicable with the insertion hole 52 and the extension hole 53 is formed in a state where the accommodating hole 58 can accommodate a distal end of a valve stem 51. An end portion of the accommodating hole 58 on a side of the insertion hole 52 is opened in a flat contact surface 59, which is formed on a lower outer surface of the slide pin 46 so as to face the insertion hole 52. Furthermore, the contact surface 59 is formed in a relatively elongated shape along the axial direction of the slide pin 46. The accommodating hole 58 is opened in a portion of the contact surface 59 on a spring chamber 57 side.

The slide pin 46 is configured to be slidable in the axial direction in a state where hydraulic power that acts on one end side of the slide pin 46 by an oil pressure of the hydraulic chamber 45 and a spring force that acts on another end side of the slide pin 46 by the return spring 47 are balanced. In a non-operable state in which the oil pressure in the hydraulic chamber 45 is low, the slide pin 46 is moved rightwardly in FIG. 4 so as to allow a distal end portion of the valve stem 51, which is inserted into the insertion hole 52, to be accommodated in the accommodating hole 58. On the other hand, in an operable state in which the oil pressure in the hydraulic chamber 45 becomes high, the slide pin is moved leftwardly in FIG. 4 so as to move the axis of the accommodating hole 58 from the axes of the insertion hole 52 and the extension hole 53, thus bringing the distal end of the valve stem 51 into contact with the contact surface 59.

Furthermore, when the slide pin 46 is moved to a position where the accommodating hole 58 of the slide pin 46 is coaxially in communication with the insertion hole 52 and the extension hole 53, the pin holder 44 and the slide pin 46 are also moved to an intake-valve-30 side together with the intake-side valve lifter 39 along with the sliding of the intake-side valve lifter 39 due to a pushing force applied from the intake-side valve operating cam 37. However, the distal end portion of the valve stem 51 is merely accommodated in the accommodating hole 58 and the extension hole 53. A pushing force in the valve opening direction is not applied to the intake valve 30 from the intake-side valve lifter 39 and the pin holder 44. Hence, the intake valve 30 is held in a rest state. Furthermore, when the slide pin 46 is moved to a position where the distal end portion of the valve stem 51 is brought into contact with the contact surface 59, the intake-side valve lifter 39 is slid by a pushing force that is applied from the intake-side valve operating cam 37. Therefore, the pin holder 44 and the slide pin 46 are moved in the direction toward intake-side valve lifter 39 along with the sliding of the intake-side valve lifter 39, and a pushing force in the valve opening direction is applied to the intake valve 30 along with the movement toward the intake valve 30 side of the pin holder 44 and the slide pin 46. Hence, the intake valve 30 is opened or closed corresponding to the rotation of the intake-side valve operating cam 37.

When the slide pin 46 is rotated about an axis thereof in the inside of the pin holder 44, the axis of the accommodating hole 58 is offset from the axes of the insertion hole 52 and the extension hole 53 and, at the same time, it becomes impossible to bring the distal end portion of the valve stem 51 into contact with the contact surface 59. Hence, the rotation of the slide pin 46 about the axis is interrupted by the stopper pin 48.

The stopper pin 48 is configured to be fitted in mounting holes 60 that are coaxially formed in the bridge portions 44*b* of the pin holder 44 so as to sandwich one end-side portion of the slide hole 50 therebetween. The stopper pin 48 penetrates a slit 61 that is formed in one end side of the slide pin 46 and opens toward a hydraulic-chamber-45 side. That is, by mounting the stopper pin 48 in the pin holder 44 and to penetrate the slide pin 46, while allowing movement of the slide pin 46 in the axial direction, the stopper pin 48 is brought into contact with an inner-end closed portion of the slit 61. Hence, a moving end of the slide pin 46 on the hydraulic-chamber-45 side is also restricted.

A coil spring 62 is provided for biasing the pin holder 44 in the direction to bring a shim 55 mounted on the pin holder 44 into contact with the projection 56 mounted on a center portion of an inner surface of a closed-end of the intake-side valve lifter 39. Such a coil spring 62 is arranged between the pin holder 44 and the cylinder head 15 in a state where the coil spring 62 surrounds the valve stem 51 at a position that can prevent an outer periphery of the coil spring 62 from being brought into contact with an inner surface of the intake-side valve lifter 39. On a bridge portion 44*b* of the pin holder 44, a pair of projections 63, 63, which position an end portion of the coil spring 62 in the direction orthogonal to an axis of the valve stem 51, is integrally mounted in a projecting manner.

Furthermore, both projections 63, 63 are integrally formed on the pin holder 44 in a projecting manner with a projection quantity equal to or below a wire diameter of the coil spring 62. The projections 63, 63 are formed in an arcuate shape about an axis of the valve stem 51. Furthermore, on one of the projections 63, 63, a stepped portion 63*a* is formed. The stepped portion 63*a* comes into contact with an intake-valve-33R-side end portion of a stopper pin 48 and prevents the movement of the stopper pin 48 toward an intake-valve-30 side.

A communication hole 64 is formed in the slide pin 46 for allowing the spring chamber 57 to be in communication with the accommodating hole 58. This prevents the pressurizing and depressurizing of the spring chamber 57 attributed to the axial movement of the slide pin 46. A communication hole 65 for allowing the space to be in communication with the spring chamber 57 is formed in the pin holder 44. This prevents a pressure in a space defined between the pin holder 44 and an intake-side valve lifter 39 from being changed due to a temperature change.

A support hole 66 is formed in the cylinder head 15 for allowing the fitting of an intake-side valve lifter 39 therein in a state that the intake-side valve lifter 39 is slidably supported by the cylinder head 15. An annular recessed portion 67 that surrounds the intake-side valve lifter 39 is formed in an inner surface of the support hole 66. Furthermore, a communication hole 68 and a release hole 69 are formed in the intake-side valve lifter 39. The communication hole 68 and the release hole 69 are provided for allowing the annular recessed portion 67 to be in communication with the annular groove 49 of the pin holder 44 irrespective of the slide movement of the intake-side valve lifter 39 in the inside of the support hole 66. The release hole 69 is formed at a position which allows the annular recessed portion 67 to be in communication with the inside of the intake-side valve lifter 39 below the pin holder 44 when the intake-side valve lifter 39 is moved to an uppermost position in FIG. 4 and interrupts the communication of the inside of the intake-side valve lifter 39 with the annular recessed portion 67 along with the downward movement of the intake-side valve lifter 39 from the uppermost position shown in FIG. 4. Due to such a construction, a working oil is blown off into the inside of the intake-side valve lifter 39 from the release hole 69.

To focus on FIG. 2, oil pressure in the hydraulic valve rest mechanisms 43 is individually controlled by hydraulic control devices 71. These hydraulic control devices 71 are arranged on portions of the engine body 11 corresponding to cylinders to be expected to assume a cylinder rest state, that is, cylinders at both ends in the cylinder arranging direction. The hydraulic control devices 71 are directly mounted on the head cover 16 which constitutes a portion of the engine body 11 and is joined to the cylinder head 15. As shown in FIG. 2, at least a portion of each of the hydraulic control devices 71 is arranged within an boundary 18B formed by the outer surface 18A of the piston 18 fitted within the cylinder that is expected to assume a cylinder rest state. The outer surface 18A of the piston 18 is parallel to the cylinder axis C.

To explain the embodiment also in conjunction with FIG. 8 and FIG. 9, on portions of an upper surface of the head cover 16 which correspond to the cylinders at both ends in the cylinder arranging direction, flat mounting surfaces 74, 74 are respectively formed. The hydraulic control device 71 is constituted of a spool valve 72 which is mounted on the mounting surface 74 and a solenoid-operated valve 73 which is mounted on the spool valve 72. The spool valve 72 includes a valve housing 75 which has an inlet port 77 and an outlet port 78 and is fastened to the mounting surface 74, and a spool valve element 76 which is slidably fitted into the valve housing 75.

A bottomed slide hole 79 that closes one end thereof and opens another end thereof is formed in the valve housing 75. A cap 80 that closes another end opening portion of the slide hole 79 is fitted in the valve housing 75. Furthermore, spool valve element 76 is slidably fitted into the slide hole 79. A spring chamber 81 is defined between the spool valve element 76 and an one-end closing portion of the slide hole 79, while a pilot chamber 82 is defined between another end of the spool valve element 76 and the cap 80. A spring 83, which biases the spool valve element 76 toward a side which decreases a capacity of the pilot chamber 82, is accommodated in the spring chamber 81.

The inlet port 77 and the outlet port 78 are formed in the valve housing 75 at positions that are sequentially spaced apart along an axis of the slide hole 79 from one end to another end side in a state that the inlet port 77 and the outlet port 78 opens in an inner surface of the slide hole 79. An annular recessed portion 84, which allows the inlet port 77 and the outlet port 78 to communicate with each other, is formed in the spool valve element 76. As shown in FIG. 9, when the spool valve element 76 is moved to assume a position which minimizes a capacity of the pilot chamber 82, the spool valve element 76 is in a state where the communication between the inlet port 77 and the outlet port 78 is interrupted.

An oil filter 85 is fitted in the inlet port 77, and an orifice hole 86, which allows the inlet port 77 and the outlet port 78 to be in communication with each other, is formed in the valve housing 75. Accordingly, even when the spool valve element 76 is arranged at a position where the communication between the inlet port 77 and the outlet port 78 is interrupted as shown in FIG. 9, the inlet port 77 and the outlet port 78 are in communication with each other through the orifice hole 86. Hence, working oil that is supplied to the inlet port 77 is squeezed by the orifice hole 86 and flows into the outlet port 78 side.

Furthermore, in the valve housing 75, a release port 87, which is in communication with the outlet port 78 through an annular recessed portion 84 only when the spool valve element 76 is arranged at the position where the communication between the inlet port 77 and the outlet port 78 is interrupted, is formed. The release port 87 opens into a space defined between the cylinder head 15 and the head cover 16.

A passage 88, which is normally in communication with the inlet port 77, is formed in the valve housing 75. The passage 88 is connected with a connection hole 89, which is formed in the valve housing 75 and is in communication with a pilot chamber 82 by way of the solenoid-operated valve 73. Accordingly, when the solenoid-operated valve 73 is operated to open the valve, oil pressure is supplied to the pilot chamber 82, and a hydraulic force of the oil pressure introduced into the inside of the pilot chamber 82 drives the spool valve element 76 in the direction toward a side which increases a capacity of the pilot chamber 82. Hence, the inlet port 77 and the outlet port 78 are in communication with each other through the annular recessed portion 84 formed in the spool valve element 76.

In the inside of the crankcase 13, an oil pump (not shown in the drawing), which is interlockingly operated with the crankshaft 12, is housed. A working oil supplied from the oil pump is supplied to an oil passage 91 formed in the head cover 16 by way of a hydraulic hose 90. The oil passage 91 is in communication with the inlet ports 77 in both hydraulic control devices 71, 71.

Furthermore, in the head cover 16, an oil passage 92A, which is in communication with the outlet port 78 of one hydraulic control device 71, is formed in a state where the oil passage 92A extends toward one end side in the cylinder arranging direction. An oil passage 92B, which is in communication with the outlet port 78 of another hydraulic control device 71, is formed in a state where the oil passage 92B extends toward another end side in the cylinder arranging direction. Oil passages 93 (see FIG. 4), which are formed in the cylinder head 15 in a state where the oil passages 93 are in communication with the oil passages 92A, 92B, are in communication with the annular recessed portions 67 in the respective hydraulic valve rest mechanisms 43.

To explain the manner of operation of this embodiment, the hydraulic valve rest mechanisms are mounted on the valve operating device 34. The valve operating device 34 performs open-close driving of the intake valves 30 of the respective cylinders of the in-line four-cylinder internal combustion engine. The hydraulic valve rest mechanisms 43 are operated with oil pressure that is controlled by the hydraulic control devices 71 so as to close and rest one or more intake valves 30 of one or more cylinders for bringing the cylinders into a rest state. The hydraulic control devices 71 are arranged on the engine body 11 directly above a portion thereof corresponding to the cylinder that is expected to assume the cylinder rest state. Accordingly, the entire internal combustion engine can be miniaturized along the axis of the crankshaft 12 and, at the same time, it is possible to shorten lengths of the oil passages 92A, 92B. 93 that connect the hydraulic valve rest mechanism 43 and the hydraulic control devices 71 with each other.

Furthermore, the hydraulic control devices 71 are directly mounted on the head cover 16, which constitutes a portion of the engine body 11 and is joined to the cylinder head 15. Hence, parts that are exclusively used for supporting the hydraulic control devices 71 become unnecessary. Therefore, the number of parts is reduced to reduce manufacturing costs. It is also possible to shorten lengths of the oil passages 92A, 92B, 93 that connect the hydraulic valve rest mechanisms 43 and the hydraulic control devices 71 with each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-cylinder internal combustion engine, comprising:

a valve operating device, said valve operating device performing open-close driving of an engine valve that is arranged in a cylinder head of an engine body in an openable-and-closable manner, the engine body having a plurality of cylinders, each of the plurality of cylinders having a piston fitted therein;

a hydraulic control device;

a hydraulic valve rest mechanism mounted on the valve operating device, said hydraulic valve rest mechanism being operated by oil pressure that is controlled by the hydraulic control device so as to close and rest engine valves of at least one of the plurality of cylinders, said hydraulic valve rest mechanism for bringing the cylinders into a rest state, wherein said hydraulic control device is arranged on a head cover of the cylinder head and at least a part of the hydraulic control device is arranged within a boundary formed by an outer surface of the piston fitted within the cylinder that is expected to assume a cylinder rest state, the outer surface of the piston being parallel to a longitudinal axis of the cylinder.

2. The multi-cylinder internal combustion engine according to claim 1, wherein the hydraulic control device is directly mounted on a head cover that constitutes a portion of the engine body and is joined to the cylinder head.

3. The multi-cylinder internal combustion engine according to claim 2, wherein the engine body is configured to include four cylinders in series, and the hydraulic valve rest mechanism is mounted on the valve operating device at portions thereof that correspond to the four cylinders at opposite ends along an arranging direction of the four cylinders.

4. The multi-cylinder internal combustion engine according to claim 1, wherein the engine body is configured to include four cylinders in series, and the hydraulic valve rest mechanism is mounted on the valve operating device at portions thereof that correspond to the four cylinders at opposite ends along an arranging direction of the four cylinders.

5. The multi-cylinder internal combustion engine according to claim 1, wherein the hydraulic valve mechanism comprises:

a pin holder slidably fitted in an intake-side valve lifter of the valve operating device;

a slide pin slidably fitted in the pin holder, the slide pin forming a hydraulic chamber between the slide pin and an inner surface of the intake-side valve lifter;

a return spring provided between the slide pin and the pin holder, the return spring biasing the slide pin in a direction that decreases a capacity of the hydraulic chamber; and a stopper provided between the pin holder and the slide pin, the stopper preventing the slide pin from being rotated about an axis of the slide pin.

6. The multi-cylinder internal combustion engine according to claim 5, wherein the pin holder comprises:

a ring portion slidably fitted inside of the intake-side valve lifter;

a bridge portion connecting portions of an inner periphery of the ring portion along one diameter line of the ring portion, wherein hollow spaces are formed between the inner periphery of the ring portion and side surfaces of the bridge portion.

7. The multi-cylinder internal combustion engine according to claim 1, wherein the valve operating device comprises:

an intake-side cam shaft;

intake-side valve-operating cams; and intake-side valve lifters interposed between the intake-side valve-operating cams and the intake valves.

8. The multi-cylinder internal combustion engine according to claim 7, wherein the hydraulic valve mechanism comprises:

a pin holder slidably fitted in the intake-side valve lifter;

a slide pin slidably fitted in the pin holder, the slide pin forming a hydraulic chamber between the slide pin and an inner surface of the intake-side valve lifter;

a return spring provided between the slide pin and the pin holder, the return spring biasing the slide pin in a direction that decreases a capacity of the hydraulic chamber; and a stopper provided between the pin holder and the slide pin, the stopper preventing the slide pin from being rotated about an axis of the slide pin.

9. The multi-cylinder internal combustion engine according to claim 8, wherein the pin holder comprises:

a ring portion slidably fitted inside of the intake-side valve lifter;

a bridge portion connecting portions of an inner periphery of the ring portion along one diameter line of the ring portion, wherein hollow spaces are formed between the inner periphery of the ring portion and side surfaces of the bridge portion.

10. A multi-cylinder internal combustion engine, comprising:

a hydraulic valve rest mechanism mounted on a valve operating device of the internal combustion engine, said hydraulic valve rest mechanism for bringing the cylinders into a rest state, said hydraulic valve rest mechanism being operated by oil pressure that is controlled by a hydraulic control device of the internal combustion engine so as to close and rest engine valves of at least one of a plurality of cylinders of the internal combustion engine, each of the plurality of cylinders having a piston fitted therein., wherein said hydraulic control device is arranged on a head cover of a cylinder head of the internal combustion engine and at least a part of the hydraulic control device is arranged within a boundary formed by an outer surface of the piston fitted within the cylinder that is expected to assume a cylinder rest state, the outer surface of the piston being parallel to a longitudinal axis of the cylinder.

11. The multi-cylinder internal combustion engine according to claim 10, wherein the hydraulic control device is directly mounted on a head cover that constitutes a portion of the engine body and is joined to the cylinder head.

12. The multi-cylinder internal combustion engine according to claim 11, wherein the engine body is configured to include four cylinders in series, and the hydraulic valve rest mechanism is mounted on the valve operating device at portions thereof that correspond to the four cylinders at opposite ends along an arranging direction of the four cylinders.

13. The multi-cylinder internal combustion engine according to claim 10, wherein the engine body is configured to include four cylinders in series, and the hydraulic valve rest mechanism is mounted on the valve operating device at portions thereof that correspond to the four cylinders at opposite ends along an arranging direction of the four cylinders.

14. The multi-cylinder internal combustion engine according to claim 10, wherein the hydraulic valve mechanism comprises:

a pin holder slidably fitted in an intake-side valve lifter of the valve operating device;

a slide pin slidably fitted in the pin holder, the slide pin forming a hydraulic chamber between the slide pin and an inner surface of the intake-side valve lifter;

a return spring provided between the slide pin and the pin holder, the return spring biasing the slide pin in a direction that decreases a capacity of the hydraulic chamber; and a stopper provided between the pin holder and the slide pin, the stopper preventing the slide pin from being rotated about an axis of the slide pin.

15. The multi-cylinder internal combustion engine according to claim 14, wherein the pin holder comprises:

a ring portion slidably fitted inside of the intake-side valve lifter;

a bridge portion connecting portions of an inner periphery of the ring portion along one diameter line of the ring portion, wherein hollow spaces are formed between the inner periphery of the ring portion and side surfaces of the bridge portion.

16. The multi-cylinder internal combustion engine according to claim 10, wherein the valve operating device comprises:

an intake-side cam shaft;

intake-side valve-operating cams; and intake-side valve lifters interposed between the intake-side valve-operating cams and the intake valves.

17. The multi-cylinder internal combustion engine according to claim 16, wherein the hydraulic valve mechanism comprises:

a pin holder slidably fitted in the intake-side valve lifter;

a slide pin slidably fitted in the pin holder, the slide pin forming a hydraulic chamber between the slide pin and an inner surface of the intake-side valve lifter;

a return spring provided between the slide pin and the pin holder, the return spring biasing the slide pin in a direction that decreases a capacity of the hydraulic chamber; and a stopper provided between the pin holder and the slide pin, the stopper preventing the slide pin from being rotated about an axis of the slide pin.

18. The multi-cylinder internal combustion engine according to claim 17, wherein the pin holder comprises:

a ring portion slidably fitted inside of the intake-side valve lifter;

a bridge portion connecting portions of an inner periphery of the ring portion along one diameter line of the ring portion, wherein hollow spaces are formed between the inner periphery of the ring portion and side surfaces of the bridge portion.

* * * * *